United States Patent [19]

Thomas

[11] 4,225,319

[45] Sep. 30, 1980

[54] ADSORBENT-TREATED CAT CRACKED GASOLINE IN MOTOR FUELS

[75] Inventor: Stephen P. Thomas, Bartlesville, Okla.

[73] Assignee: Phillips Petroleum Company, Bartlesville, Okla.

[21] Appl. No.: 922,257

[22] Filed: Jul. 5, 1978

[51] Int. Cl.[2] ..... C10L 1/22

[52] U.S. Cl. ..... 44/72; 208/17; 208/299

[58] Field of Search ..... 44/72, 80; 208/17, 299, 208/260

[56] References Cited

U.S. PATENT DOCUMENTS

| | | | |
|---|---|---|---|
| 2,360,585 | 10/1944 | Ross et al. | 44/80 |
| 2,501,223 | 3/1950 | Johnson | 44/80 |
| 3,529,944 | 9/1970 | Leas | 44/70 |
| 3,556,748 | 1/1971 | Sledman | 44/72 |
| 3,600,413 | 8/1971 | Grimm | 44/72 |

*Primary Examiner*—Winston A. Douglas
*Assistant Examiner*—J. V. Howard

[57] ABSTRACT

A method for supressing carburetor deposit formation of motor fuels containing untreated cat cracked gasoline by blending adsorbent-treated cat cracked gasoline into the motor fuel. Up to about 50 percent by weight of the total composition is adsorbent-treated cat cracked gasoline, but preferably from about 5 to about 25 percent by weight of the total composition is adsorbent-treated cat cracked gasoline. In a preferred embodiment a standard reference fuel capable of providing a predetermined level of carburetor deposit formation is provided by the addition of either adsorbent-treated cat cracked gasoline, untreated cat cracked gasoline, or aromatic amines to a base fuel.

12 Claims, No Drawings

ADSORBENT-TREATED CAT CRACKED GASOLINE IN MOTOR FUELS

BACKGROUND OF THE INVENTION

This invention relates to blended fuels for internal combustion engines. In one of its aspects this invention relates to the supression of carburetor deposit formation in internal combustion engines. In another aspect of the invention it relates to the use of adsorbent-treated cat cracked gasoline in fuel compositions. In still another aspect of the invention it relates to the preparation of a standard reference fuel for evaluating carburetor detergents for fuel and lubricating oil formulations.

Although it has long been well known in the art to treat gasoline, jet fuel, synthetic gasoline, and other hydrocarbon liquids with the materials such as charcoal, silica-alumina, and other adsorbents to remove oxygen-, nitrogen-, and sulfur-containing compounds it has recently been found that upon adsorbent treatment of cat cracked gasoline a treated material is obtained that is suitable for blending with a fuel composition containing untreated cat cracked gasoline to obtain a fuel that produces an unexpectedly low level of carburetor deposits.

It has also been found that the use of adsorbent-treated cat cracked gasoline as a fuel blending stock provides a means for producing a standard reference fuel for use in evaluating carburetor detergents and lubricating oil formulations by adjusting the level of carburetor deposit formation of a base fuel. The adsorbent-treated cat cracked gasoline can be used to lower the deposit level of a fuel stock and the deposit level of a fuel stock could be adjusted upward by the addition of untreated cat cracked fuel. Another direct means for adjusting the deposit level upward is the addition of primary aromatic amines (anilines) to a base fuel. The addition of the primary aromatic amines would result in a test fuel that would be of low cost and necessary cleanliness and would also produce "typical" carburetor and induction system deposits since the additives would be among those naturally occurring deposit precursors found in gasolines.

It is therefore an object of this invention to provide a method for suppressing the level of carburetor deposit formation in a fuel composition containing untreated cat cracked gasoline. It is another object of the invention to provide a fuel blend suitable for producing low carburetor deposit formation. It is another object of the invention to provide standard reference fuel for evaluating carburetor detergents for fuel and lubricating oil formulations. It is still another object of the invention to provide a method for preparing a standard reference fuel for evaluating carburetor detergents for fuel and lubricating oil formulations.

Other aspects, objects, and the various advantages of this invention will become apparent upon study of this specification and the appended claims.

STATEMENT OF THE INVENTION

According to this invention a method is provided for supressing carburetor deposit formation of fuel compositions containing untreated cat cracked gasoline. In the method, adsorbent-treated cat cracked gasoline is blended with a fuel composition thereby decreasing the carburetor deposit formation when the fuel is used in an internal combustion engine.

In an embodiment of the invention a fuel blend suitable for producing low carburetor deposit formation is provided with a blend comprising untreated cat cracked gasoline and a carburetor deposit reducing amount of adsorbent-treated cat cracked gasoline.

In another embodiment of the invention a standard reference fuel for evaluating carburetor detergents for fuel and lubricating oil formulations and a method for preparing this standard reference fuel is provided. The method provides the addition to a base fuel of sufficient amounts of an additive chosen from adsorbent-treated cat cracked gasoline, untreated cat cracked gasoline, and aromatic amines to provide a predetermined level of carburetor deposit formation.

The base gasoline employed in this invention can be any of the well-known hydrocarbon fractions in the gasoline boiling range. The base fuel can contain straight chain or branched chain paraffins, cycloparaffins, olefins, and aromatic compounds or any mixtures thereof, such hydrocarbons being obtainable from straight-run naphtha, polymer gasoline, natural gasoline, thermally or catalytically cracked hydrocarbons and catalytically reformed stocks. This invention is most useful with those base gasolines which result in significant amounts of carburetor deposits. It is well known in the art that cat cracked gasolines frequently result in excessive carburetor deposits and thus, fuel compositions containing cat cracked gasolines frequently must contain detergents and other additives to reduce the amount of deposits formed. This invention is particularly useful with those base gasolines which contain significant amounts of cat cracked gasoline. For example, commercially available fuels based upon blends of alkylate and cat cracked gasoline are benefited by this invention.

Cat cracked gasolines, useful in this invention as fuel-blending stocks as described above and in treatment according to this invention with adsorbent for subsequent use as a fuel-blending stock, are well known in the art. It is well known in the art to crack catalytically many different heavy streams resulting from operations to refine crude materials. For example, heavy naphtha, gas oil, or heavier streams are employed as feed stocks to catalytic crackers. It is known in the art that heavier feeds contain more oxygen- and nitrogen-containing species which ultimately appear in the cat cracked gasoline. As is well known in the art the effluent from a catalytic cracker is fractionated to give a variety of products. Those fractions generally boiling in the same range as useful gasolines are employed as fuel-blending stocks. The art indicates that oxygen- and nitrogen-containing materials in the cat cracked gasoline which contribute to carburetor deposit formation include substituted phenols and substituted aromatic amines such as anilines, pyridines, indoles and higher molecular weight materials.

Adsorbents which are useful in the present invention for treating the cat cracked gasoline include many of the well known adsorbents such as silica, alumina, silica-alumina, charcoal, carbon black, magnesium silicate, aluminum silicate, zeolites, clay, fuller's earth, magnesia, and the like. A wide variety of such materials is currently commercially available in a wide variety of particle sizes and surface areas. Particle size and surface area are not deemed to be critical in the practice of the present invention, but can be selected by the practitioner in accordance with current availability, his facilities and his desired operating conditions.

The conditions employed in the treatment of the cat cracked gasoline with the adsorbent can vary over a broad range depending on the level of carburetor deposit formation from the base fuel and the desired level of reduction of this carburetor deposit formation. Treatment of the cat cracked gasoline with adsorbent will generally be carried out in a temperature range of 0°-100° C. and preferably near ambient conditions, such as 20°-40° C., for a period of time generally ranging from about 1 second to 1 hour. It is currently preferable to employ gravity flow of the cat cracked gasoline through a column packed with suitable adsorbent at ambient temperature. If it is desired to increase the flow through the packed column, it is within the scope of this invention to apply whatever pressure may give the desired flow rate and contact time.

Although the addition of any finite amount of adsorbent-treated cat cracked gasoline to a fuel composition containing untreated cat cracked gasoline improves deposition problems, the amount of adsorbent-treated cat cracked gasoline employed in the fuel composition of the present invention can be stated generally to be up to about 50 percent by weight of the total composition or in the range of from 1 to about 50 percent by weight of total composition, and preferably in the range of 5 to 25 weight percent.

Since it is currently believed in the art that cat cracked gasoline containing polar compounds contributes to the carburetor deposit formation and since cat cracked gasoline is widely used as a fuel-blending stock, the current invention provides the addition of adsorbent-treated cat cracked gasoline to such a blended fuel to give an ultimate weight ratio of 0.1/1 to 10/1, preferably a weight ratio of 0.5/1 to 2/1, parts of treated cat cracked gasoline per part of untreated cat cracked gasoline in the blended fuel.

EXAMPLE I

Silica gel-treated cat cracked gasoline was prepared by passing cat cracked gasoline through a glass chromatographic column packed with silica gel (Grade 11 or 12 from W. R. Grace & Co.) at the maximum flow rate obtained by gravity flow and at room temperature (about 25° C.).

The gasolines employed in Examples I and II are characterized as follows:

| | Cat Cracked | Alkylate | Premium Pipeline Base |
|---|---|---|---|
| API Gravity a 15.6° C. | 54.2 | 70.2 | 65.2 |
| Initial boiling point, °C. | 40 | 55 | 33 |
| 10% overhead | 61 | 89 | 56 |
| 50% overhead | 108 | 102 | 101 |
| 90% overhead | 186 | 118 | 174 |
| End boiling point, °C. | 216 | 158 | 214 |
| Vapor pressure, PSI | 5.2 | 2.7 | 5.25 |
| Motor Octane No. (MON) | 79.4 | 91.6 | 84.7 |
| Research Octane No. (RON) | 91.7 | 92.6 | 92.9 |
| Composition, Vol. % | | | |
| Paraffin | 21.9 | 100 | 69.7 |
| Olefin | 38.9 | 0 | 14.6 |
| Naphthene | 7.7 | 0 | 4.3 |
| Aromatic | 31.5 | 0 | 11.4 |

In the following inventive and comparative runs, treated and untreated cat cracked gasolines were blended with alkylate. The resulting blends were employed as the fuel for a 170 cubic inch displacement 6 cylinder automobile engine with a tared removable carburetor throat insert. Operation of the engine was for 23 continuous hours at 1800 rpm and 11.4 brake horsepower. After these conditions of operation the insert was removed, washed with n-heptane, subsequently dried, and weighed to give the weight (in milligrams) of deposit formed.

In Table I are given the results of the above-described tests employing as the motor fuel the alkylate, alkylate/untreated cat cracked gasoline blends, alkylate/-treated cat cracked gasoline blends, and alkylate/-treated and untreated cat cracked gasoline blend.

Table I

| Run Number | Alkylate | UCCG[1] | TCCG[2] | Deposits, mg. |
|---|---|---|---|---|
| 1 (Comp.) | 100 | 0 | 0 | 2.3 |
| 2 (Comp.) | 90 | 10 | 0 | 7.3 |
| 3 (Comp.) | 80 | 20 | 0 | 10.3 |
| 4 (Inv.) | 90 | 0 | 10 | 2.3 |
| 5 (Inv.) | 80 | 0 | 20 | 3.6 |
| 6 (Inv.) | 80 | 10 | 10 | 4.5 |

[1]Untreatd cat cracked gasoline
[2]Silica gel-treated cat cracked gasoline

The results of comparative runs 1, 2 and 3 in Table I demonstrate that the addition of untreated cat cracked gasoline to alkylate results in a substantial increase in carburetor deposits with increasing amount of untreated cat cracked gasoline. The results of inventive runs 4 and 5 demonstrate that the use of 10 volume percent of treated cat cracked gasoline in alkylate gives no detectable increase in carburetor deposits and that 20 volume percent treated cat cracked gasoline in alkylate gives only a slight increase in carburetor deposits. The result of inventive run 6 demonstrates that the mixture of 10 volume percent untreated cat cracked gasoline and 10 volume percent treated cat cracked gasoline in alkylate gives substantially less carburetor deposits than the use of not only 20 percent untreated cat cracked gasoline, but also of 10 percent untreated cat cracked gasoline. The result of run 6 demonstrates a deposit level lower than would be expected by simply diluting a fuel blend containing 10 percent untreated cat cracked gasoline with a clean fuel such as alkylate or a clean cat cracked gasoline.

EXAMPLE II

The following inventive and comparative runs demonstrate the use of this invention with a commercially available gasoline base.

To a Kansas City premium pipeline gasoline base containing 60 percent alkylate and 40 percent cat cracked gasoline was added 20 percent by volume of either alkylate or a 1/1 blend of alkylate and the treated cat cracked gasoline described in Example I. The resulting blends were employed in a carburetor deposit test described in Example I, the results of which are given in Table II.

Table II

| Run No. | Base Fuel[1] | Alkylate[2] | TCCG[3] | Deposits, mg | Reduction, %[4] |
|---|---|---|---|---|---|
| 7 | 100 | 0 | 0 | 35-37 | — |
| 8 | 80 | 20 | 0 | 26.5 | 24-28 |
| 9 | 80 | 10 | 10 | 20.3 | 42-45 |

[1]See description of premium pipeline base in Example I.
[2]See description of alkylate in Example I.
[3]Cat cracked gasoline described in Example I treated with silica gel as in Example I.
[4]Percentage reduction in deposit weights of runs 8 and 9 compared to run 7.

The results in Table II demonstrate that the use of a blend of alkylate/treated cat cracked gasoline results in a significantly greater reduction in deposit formation than adding a comparable volume of only alkylate to the base gasoline which contains an untreated cat cracked gasoline. As can be observed in Table I above, runs 1, 4 and 5, treated cat cracked gasoline apparently contains slightly more deposit-forming material than alkylate alone. It was quite unexpected to see the dramatic decrease in deposit level of the fuel composition containing both treated and untreated cat cracked gasoline as per run no. 9.

It has been theorized that the adsorbent treatment of cat cracked gasoline described above removes small amounts of highly polar materials and that it is these materials—partially oxidized fuel components—that are responsible for initiating the carburetor deposit forming reactions. With this in mind it is proposed that cat cracked refinery streams which are both a primary source of olefins in gasoline and a source of partially oxidized species can be added to a base fuel to adjust the level of carburetor deposit upward by increasing the concentration of "active species". In this way a base fuel could be standardized to a specific level of carburetor deposit formation to form a standard reference fuel for evaluating carburetor detergents.

EXAMPLE III

Engine tests were performed as in Example I adding varying amounts of untreated cat cracked gasoline to the premium pipeline base fuel.

Table III

| Run No. | Concentration of Untreated Cat Cracked Gasoline in Fuel, Volume % | mg Unwashed Carburetor Sleeve Deposits |
|---|---|---|
| 10 | 0 | 9.1–9.5 |
| 11 | 5 | 12.5 |
| 12 | 10 | 20.9 |
| 13 | 15 | 27.2 |

The table above indicates the increase of carburetor deposits as concentration of untreated cat cracked gasoline in the base fuel is increased.

EXAMPLE IV

Carburetor deposit tests were run as in Example I with the same base fuel and with the addition of each of a primary amine and a secondary amine.

Table IV

| Fuel | Carburetor Deposits, mg. |
|---|---|
| Base fuel | 11.6, 13.8 & 16.6[a] |
| Base fuel + 0.05 vol. % p-n-butylaniline | 32.0 |
| Base fuel + 0.05 vol. % N-methylaniline | 14.6 |

[a]Triplicate determinations.

The tests indicate that a primary amine is effective in raising the deposit level whereas a secondary amine is not.

The results of runs 1 through 3 and 11 through 13 in the examples above indicate the effectiveness of untreated cat cracked gasoline raising the level of carburetor deposit in a fuel composition. The runs of Table IV indicate that a primary amine is also effective in raising the carburetor deposit level of a fuel composition. Runs 6 and 9 indicate that an adsorbent-treated cat cracked gasoline is effective for reducing the deposit level of fuel composition containing an untreated cat cracked gasoline. These tests taken together show that it could reasonably be expected to produce a standard reference fuel for evaluating carburetor detergents by adding the components discussed above to raise or lower the level of carburetor deposits produced by the reference fuel.

I claim:

1. A method for suppressing carburetor deposit formation using a fuel composition containing untreated cat cracked gasoline in an internal combustion engine, said method comprising blending adsorbent-treated cat cracked gasoline with the composition.

2. A method of claim 1 wherein up to about 50 percent by weight of the total composition is adsorbent-treated cat cracked gasoline.

3. A method of claim 2 wherein about 5 to about 25 percent by weight of the total composition is adsorbent-treated cat cracked gasoline.

4. A method of claim 2 wherein the total composition also contains alkylate gasoline.

5. A fuel blend suitable for producing low carburetor deposit formation, said blend comprising untreated cat cracked gasoline and a carburetor deposit reducing amount of adsorbent-treated cat cracked gasoline.

6. A fuel blend of claim 5 wherein up to about 50 percent by weight of the total composition is adsorbent-treated cat cracked gasoline.

7. A fuel blend of claim 6 wherein about 5 to about 25 percent by weight of the total composition is adsorbent-treated cat cracked gasoline.

8. A fuel blend of claim 6 wherein the total composition also contains alkylate gasoline.

9. A standard reference fuel for evaluating carburetor detergents for fuel and lubricating formulations, said reference fuel comprising a base fuel and additive chosen from (1) adsorbent-treated cat cracked gasoline compositions that reduce the level of carburetor deposit formation and (2) compositions that increase the level of carburetor deposit formation chosen from untreated cat cracked gasoline and primary aromatic amine, said additive present in an amount sufficient to provide a predetermined level of carburetor deposit formation.

10. A standard reference fuel of claim 9 wherein the additive is chosen from adsorbent-treated cat cracked gasoline and untreated cat cracked gasoline.

11. A method for preparing a standard reference fuel for evaluating carburetor detergents for fuel and lubricating oil formulations, said method comprising blending a base fuel with additive chosen from (1) adsorbent-treated cat cracked gasoline compositions that will decrease the level of carburetor deposit formation and (2) compositions that will increase the level of carburetor deposit formation chosen from untreated cat cracked gasoline and primary aromatic amine, said additive in a sufficient amount to provide a predetermined level of carburetor deposit formation.

12. A method of claim 11 wherein said additive is chosen from adsorbent-treated cat cracked gasoline and untreated cat cracked gasoline.

* * * * *